US008596227B2

(12) United States Patent
Heinrichs

(10) Patent No.: US 8,596,227 B2
(45) Date of Patent: Dec. 3, 2013

(54) STEAM GENERATOR

(75) Inventor: Fred Heinrichs, Bornstedt (DE)

(73) Assignee: Siemens Aktiengesellschaft, München (DE)

( * ) Notice: Subject to any disclaimer, the term of this patent is extended or adjusted under 35 U.S.C. 154(b) by 967 days.

(21) Appl. No.: 12/672,129

(22) PCT Filed: Aug. 1, 2008

(86) PCT No.: PCT/EP2008/060149

§ 371 (c)(1),
(2), (4) Date: Feb. 4, 2010

(87) PCT Pub. No.: WO2009/021861

PCT Pub. Date: Feb. 19, 2009

(65) Prior Publication Data

US 2011/0030624 A1 Feb. 10, 2011

(30) Foreign Application Priority Data

Aug. 10, 2007 (EP) ..... 07015829

(51) Int. Cl.
*F22B 37/24* (2006.01)

(52) U.S. Cl.
USPC ..... 122/510; 376/461

(58) Field of Classification Search
USPC ..... 122/510, 511; 376/461, 462; 248/68.1
See application file for complete search history.

(56) References Cited

U.S. PATENT DOCUMENTS

| | | | | |
|---|---|---|---|---|
| 4,576,120 | A * | 3/1986 | Ammann | 122/6 A |
| 4,685,426 | A | 8/1987 | Bryk | |
| 5,329,892 | A * | 7/1994 | Svendsen | 122/510 |
| 5,722,354 | A * | 3/1998 | Sansoucy | 122/510 |
| 6,039,008 | A * | 3/2000 | Anderson et al. | 122/510 |
| 6,092,591 | A * | 7/2000 | McDonald et al. | 165/162 |
| 6,186,221 | B1 * | 2/2001 | Beauregard et al. | 165/82 |
| 2007/0272172 | A1 * | 11/2007 | Kawaguchi et al. | 122/510 |
| 2008/0276885 | A1 * | 11/2008 | Seppanen et al. | 122/510 |
| 2010/0154726 | A1 * | 6/2010 | Zaman | 122/493 |
| 2011/0094455 | A1 * | 4/2011 | Kikuchi | 122/510 |

FOREIGN PATENT DOCUMENTS

| | | |
|---|---|---|
| FR | 998913 A | 12/1964 |
| FR | 1417696 A | 11/1965 |

* cited by examiner

*Primary Examiner* — Gregory A Wilson

(57) ABSTRACT

A steam generator with a heating gas duct which in an approximately horizontal heating gas direction is exposed to throughflow of a heating medium is provided to ensure a reliable absorption of the mentioned loads, especially of the additional loads which are produced as a result of the design dependent internal pressure of the heating gas. The heating gas duct is enclosed by a plurality of support frames which are arranged one behind the other in the heating gas direction, wherein at least two of the support frames are interconnected via a plurality of horizontal batten plates.

2 Claims, 1 Drawing Sheet

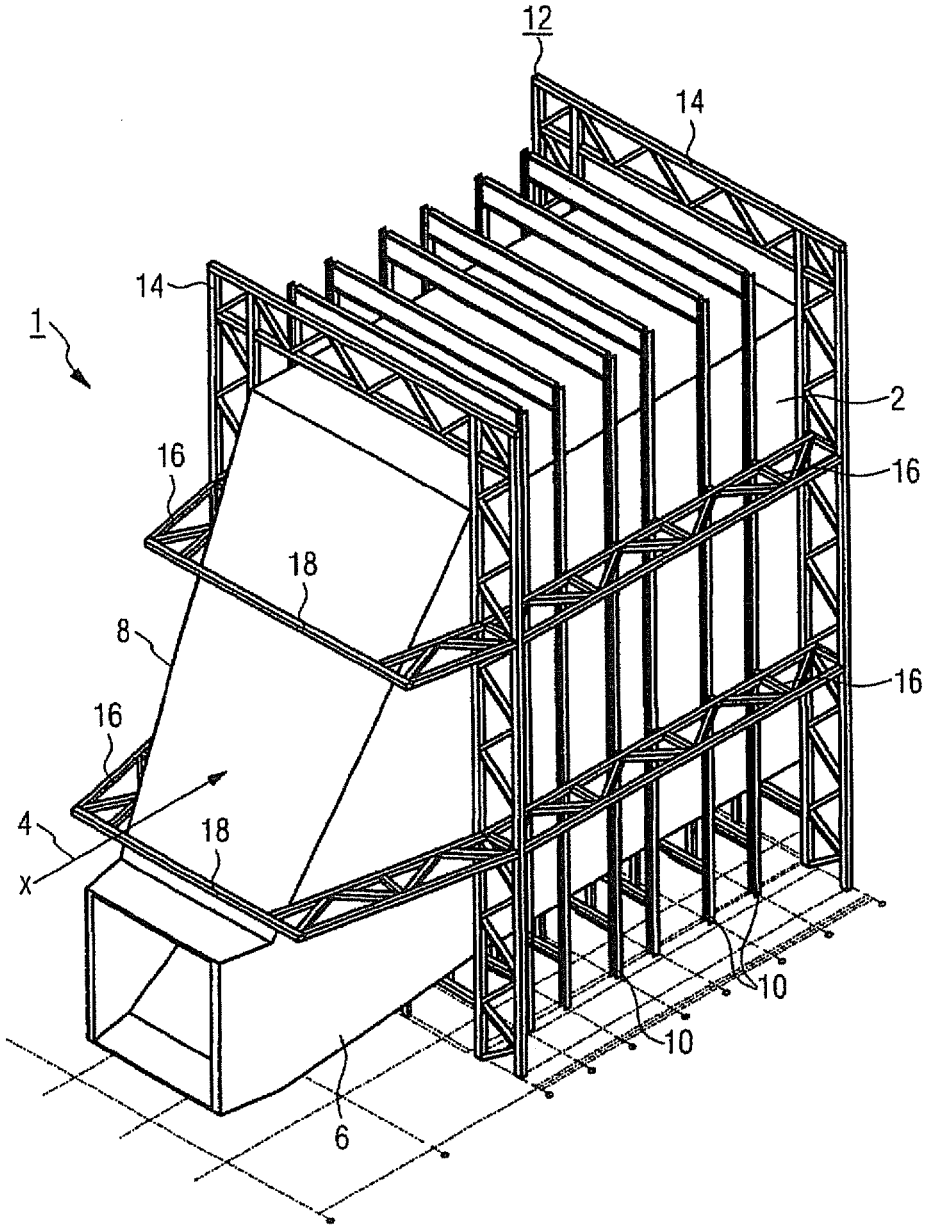
12
14
14
1
2
16
16
18
8
16
16
4
18
x
10
10
6

STEAM GENERATOR

CROSS REFERENCE TO RELATED APPLICATIONS

This application is the US National Stage of International Application No. PCT/EP2008/060149 filed Aug. 1, 2008, and claims the benefit thereof. The International Application claims the benefits of European Application No. 07015829.0 EP filed Aug. 10, 2007. All of the applications are incorporated by reference herein in their entirety.

FIELD OF INVENTION

The invention relates to a steam generator, especially in a horizontal type of construction, with a heating gas duct which in an approximately horizontal heating gas direction can be exposed to throughflow of a heating medium.

BACKGROUND OF INVENTION

In the case of a gas and steam turbine plant, the heat which is contained in the expanded working medium or heating gas from the gas turbine is used for generating steam for the steam turbine. The heat transfer is carried out in a waste heat steam generator which is connected downstream to the gas turbine and in which a number of heating surfaces for water preheating, for steam generation and for steam superheating are customarily arranged. The heating surfaces are connected into the water-steam cycle of the steam turbine. The water-steam cycle customarily comprises a plurality, for example three, of pressure stages, wherein each pressure stage can have an evaporator heating surface.

For the steam generator which as a waste heat steam generator is connected downstream on the hot gas side to the gas turbine, a plurality of alternative design concepts, specifically the design as a once-through steam generator or the design as a recirculating steam generator, come into consideration. In the case of a once-through steam generator, the heating of steam generator tubes, which are provided as evaporator tubes, leads to an evaporation of the flow medium in the steam generator tubes in a once-through pass. In contrast to this, in the case of a natural or forced-circulation steam generator, the water which is guided in the cycle during a pass through the evaporator tubes is only partially evaporated. The water which is not evaporated in the process, after a separation of the generated steam, is fed once more to the same evaporator tubes for a further evaporation, wherein the evaporated portion is replaced by water which is fed again to the evaporation system.

SUMMARY OF INVENTION

A waste heat steam generator in a horizontal type of construction, in which the heating medium or heating gas, that is to say especially the exhaust gas from the gas turbine, is guided through the steam generator in an approximately horizontal flow direction, offers particular advantages with regard to the production cost, but also with regard to necessary maintenance operations. This horizontal type of construction in comparison to the so-called vertical type of construction in which the heating medium flows through the steam generator in an essentially vertical direction, enables to keep especially the civil engineering cost comparatively low. In the civil engineering respect, a portal frame supporting structure, via which the resulting loads are introduced into the foundation, in this case is selected as a customary supporting structure solution for the sidewalls which form the outer walls of the steam generator or of its heating gas duct. In this case, on the one hand the resulting vertical loads from heating surface loads, further components, pipelines, platforms or suchlike, and on the other hand, also as a further essential load component, even the internal pressure of the flue gas or heating gas at about 70 mbar, are to be taken into consideration. Even the resulting load component as a consequence of the internal pressure of the flue gas introduces comparatively large bending moments into the supporting construction in the process, so that in the case of the design of the supporting structure correspondingly suitably dimensioned parts and components have to be made available. For the suitable absorption of these loads, therefore, a comparatively high material and production cost is required.

An object of the invention is to provide a steam generator of the aforementioned type, in which with an especially minimized cost and in an especially simple type of construction, a reliable absorption of the mentioned loads, especially of the additional loads which are produced as a result of the design-dependent internal pressure of the heating gas, is ensured.

This object is achieved according to the invention by the heating gas duct being enclosed by a number of support frames which are arranged one behind the other as seen in the heating gas direction, wherein at least two of the support frames are interconnected via a number of horizontal batten plates.

The invention starts in this case from the consideration that the production-dependent and material-dependent cost for the reliable diversion of the mentioned loads can be kept especially low by especially the load component which is introduced by the internal pressure of the flue gas not being introduced into the foundation as in customary systems via individual frame elements of the heating gas duct, but being introduced into the foundation in a concentrated manner instead. For this purpose, a number of support frames are provided, that is to say especially supports and bars, which suitably enclose the flue gas duct or heating gas duct. In order to ensure in this case a reliable introduction of the loads which cause the bending moments, these support frames should be connected via suitably positioned horizontal batten plates in the style of a latticework construction. The horizontal batten plates in this case are constructed in the style of horizontal struts. In particular, by means of the horizontal batten plates (H-latticeworks) which are connected to the support frames in the style of a latticework construction, the free span heights can be significantly reduced, for example to a third, so that the vertical supports are loaded only by about an eighth (corresponding to 12.5%) of the customary bending moment. Therefore, a reliable supporting with considerably reduced material use can be achieved. The deformations which occur are also significantly reduced by the use of H-latticeworks.

An especially reliable introduction of the loads in this case can be achieved by the latticework which is obtainable by means of the horizontal struts being made available for the outer surfaces of the heating gas duct in an especially symmetrical and equally distributed manner. For this purpose, the horizontal batten plates are advantageously arranged on the two sides of the heating gas duct. An especially symmetrical and consequently comparatively simply supported and effective construction can be achieved in this case by two horizontal struts being arranged in each case opposite each other in pairs to the heating gas duct in an especially advantageous configuration.

The components which form the latticework frame are advantageously suitably designed with regard to their material selection and dimensioning in such a way that the loads and bending moments which are introduced by the internal pressure of the flue gas, with a design-dependently based internal pressure of the heating gas of about 70 mbar, can be reliably diverted and with an adequately measured safety reserve. In this case, this design-dependent internal pressure is expediently used throughout for all the parts of the heating gas duct, although in the outlet region of the heating gas duct a comparatively lower internal pressure results during operation on account of the resulting pressure loss of the heating gas while the heating gas duct is exposed to throughflow.

Furthermore, in an especially advantageous development, consideration is suitably given to the fact that the comparatively highest internal pressure of the heating gas is customarily applied in the inlet region of the heating gas duct, by two horizontal batten plates, which are arranged on opposite sidewalls of the heating gas duct, being interconnected in the inflow region of the heating gas duct by means of an essentially horizontally oriented tie bar. Consequently, the loads which result from the internal pressure of the heating gas on the flue gas inlet side of the heating gas duct, which are about five times higher than the calculated wind loads, are coupled and compensated by means of the respective tie bar so that these loads do not have to be diverted to the foundations in dependence upon the rigidity of the latticework frame in axis A and also B.

The support frames in axis B and L, with a base of 2750 mm, advantageously feature about 1/12 the height of 31.52 m, and also the horizontal batten plates, with a base of 2.1 m, advantageously feature about 1/8 the length.

The steam generator is expediently used as a waste heat steam generator of a gas and steam turbine plant. In this case, the steam generator is advantageously connected downstream on the hot gas side to a gas turbine. With this connection, an auxiliary firing for increasing the heating gas temperature can be expediently provided downstream of the gas turbine.

The advantages which are achieved by the invention lie especially in the fact that by means of the horizontal batten plates which interconnect the support frames, a latticework frame is formed as supporting structure for the heating gas duct, via which a reliable and concentrated diversion of the resulting loads is made possible with especially minimized material and production cost. The vertical supports between the two latticework frames on the flue gas inlet side and on the flue gas outlet side of the heating gas duct are therefore indeed still loaded with the customary normal loads as a result of vertical loads, wherein, however, the resulting bending moments can be significantly reduced on account of the reduction of the free span heights. Since the bending moments are produced approximately according to the relationship $M \cong Q^*l^2/11$, the free length l can be reduced to about a third, and also the respective bending moment can be reduced to about an eighth, as a result of the reduction which can be achieved via the latticework plates.

BRIEF DESCRIPTION OF THE DRAWINGS

An exemplary embodiment of the invention is explained in more detail with reference to a drawing. The FIGURE shows a steam generator therein.

DETAILED DESCRIPTION OF INVENTION

The steam generator 1 according to the FIGURE is configured as a waste heat steam generator and is connected downstream on the exhaust gas side to a gas turbine, which is not shown. The steam generator 1 has an enclosing wall 2, which in the style of a horizontal type of construction forms a heating gas duct 6 for the exhaust gas from the gas turbine and which in an approximately horizontal heating gas direction x, which is indicated by the arrow 4, can be exposed to throughflow. In the heating gas duct 6, a number of suitably designed and dimensioned heating surfaces for preheating, evaporation and superheating of the flow medium are arranged in each case.

The enclosing wall 2, which fauns the heating gas duct 6, is constructed in this case in the exemplary embodiment in a layered manner in the customary type of construction, wherein a lagging construction, which is provided as insulation, is arranged adjacent to a metal plate, inclusive of an adjusting foot, which forms the outer skin, which lagging construction in its turn is delimited by a liner towards the interior of the heating gas duct 6. On the inlet side, the heating gas duct 6 in this case has a comparatively small free flow cross section which in the region of a transition section 8 continuously widens, as seen in the heating gas direction 4, as far as the actual free flow cross section of the heating gas duct 6.

The supporting construction of the steam generator 1 is specifically designed for a reliable absorption of the resulting loads with an especially minimized production and material cost. For this purpose, the supporting structure of the steam generator 1 on the one hand comprises a number of vertical supports 10, which with regard to dimensioning and material selection are designed in such a way that they can readily transmit the resulting vertical loads from heating surface loads, pipelines and suchlike to the foundation. On the other hand, in addition to these vertical supports, however, a latticework support frame 12 is provided, via which additional resulting loads are diverted into the foundation in a targeted and concentrated manner. The latticework support frame 12 in this case is formed from a number of support frames 14 which are arranged one behind the other, as seen in the hot gas direction x, which enclose the heating gas duct 6 in each case, and which are interconnected via a number of horizontal batten plates 16. The horizontal batten plates 16 in this case are arranged on the two sides of the heating gas duct 6 and opposite each other in pairs in each case. In the exemplary embodiment according to the FIGURE, two support frames 14 are shown, wherein depending upon possible further design criteria of the steam generator a larger number of support frames 14 could also be provided. This is advisable for example in the case of the arrangement of an auxiliary firing or of a catalyst.

In the inflow region of the heating gas duct 6, two horizontal batten plates 16 which lie opposite each other in each case are interconnected in each case by means of an essentially horizontally oriented tie bar 18. By means of the tie bars 18, especially in the inlet region of the heating gas duct 6 where the greatest internal pressure of the heating gas is customarily applied when the steam generator 1 is in operation, the loads which are produced as a result of the internal pressure, which can be up to five times higher than the wind loads, are suitably coupled and mutually compensated, so that no introduction of these loads, or the bending moments which are produced by them, via the latticework frame 12 into the foundation is necessary. The latticework frames 12 in the exemplary embodiment are constructed with a base width of about 2.75 m.

In the exemplary embodiment according to the FIGURE, on each side of the heating gas duct 6 two horizontal batten plates 16 for load absorption and dissipation to the latticework frames 12 are provided in each case. The free span heights of the respective side surfaces of the heating gas duct 6, with regard to the force and moment introduction, are consequently reduced to a third in comparison to the full overall height of the heating gas duct 6. Since the corresponding bending moments are produced according to the relationship $M \cong Q^{*}l^{2}/11$, the respective bending moment, as a result of the correspondingly smaller free span height, is therefore reduced to about an eighth or 12.5% of the resulting bending moment for the complete overall height of the heating gas duct 6. Therefore, an achievable solution is reached with correspondingly less material use and production cost which is associated with it.

The invention claimed is:

1. A steam generator, comprising:

a heating gas duct which in an approximately horizontal heating gas direction is exposed to throughflow of a heating medium;

a plurality of support frames, the heating gas duct being enclosed by the support frames which are arranged one behind the other in the heating gas direction;

a plurality of horizontal batten plates, at least two of the support frames being interconnected via the horizontal batten plates, and the horizontal batten plates being arranged on two sides of the heating gas duct; and an essentially horizontally oriented tie bar, wherein two of the horizontal batten plates are arranged on opposite sidewalls of the heating gas duct and are interconnected in an inflow region of the heating gas duct by the essentially horizontally oriented tie bar, wherein the essentially horizontally oriented tie bar directly connects to ends of the two horizontal batten plates.

2. The steam generator as claimed in claim 1, wherein a gas turbine is connected upstream on a hot gas side.

* * * * *